United States Patent [19]

Vanderheyden

[11] 3,965,704

[45] June 29, 1976

[54] DRUM FOR WASHER-EXTRACTOR MACHINES

[75] Inventor: Herman E-C Vanderheyden, Ledeberg, Belgium

[73] Assignee: Em. D'Hooge N.V., Ledeberg, Belgium

[22] Filed: July 16, 1974

[21] Appl. No.: 488,903

[30] Foreign Application Priority Data

Aug. 29, 1973 Belgium ..... 804131
June 26, 1974 Belgium ..... 53710

[52] U.S. Cl. ..... 68/210; 68/143
[51] Int. Cl.[2] ..... D06F 37/08
[58] Field of Search ..... 68/210, 142, 143, 144, 68/145, 146; 220/255, 20, 22, 253, 254, 259, 256, 252, 4 R, 5 R

[56] References Cited

UNITED STATES PATENTS

| | | | |
|---|---|---|---|
| 1,689,068 | 10/1928 | Brown | 220/5 R |
| 2,250,659 | 7/1941 | Solomon | 68/142 |
| 3,577,751 | 5/1971 | Hertig | 68/143 |

*Primary Examiner*—Richard E. Aegerter
*Assistant Examiner*—Willis Little
*Attorney, Agent, or Firm*—Bacon & Thomas

[57] ABSTRACT

Drum for washer-extractor machines comprising: two end plates; connecting means between these plates; and a shell consisting of a series of panels hinged with their longitudinal sides one to another, the first panel of the series being anchored to a component of said connecting means and the last panel being fitted with locking means cooperating with said component of said connecting means.

5 Claims, 11 Drawing Figures

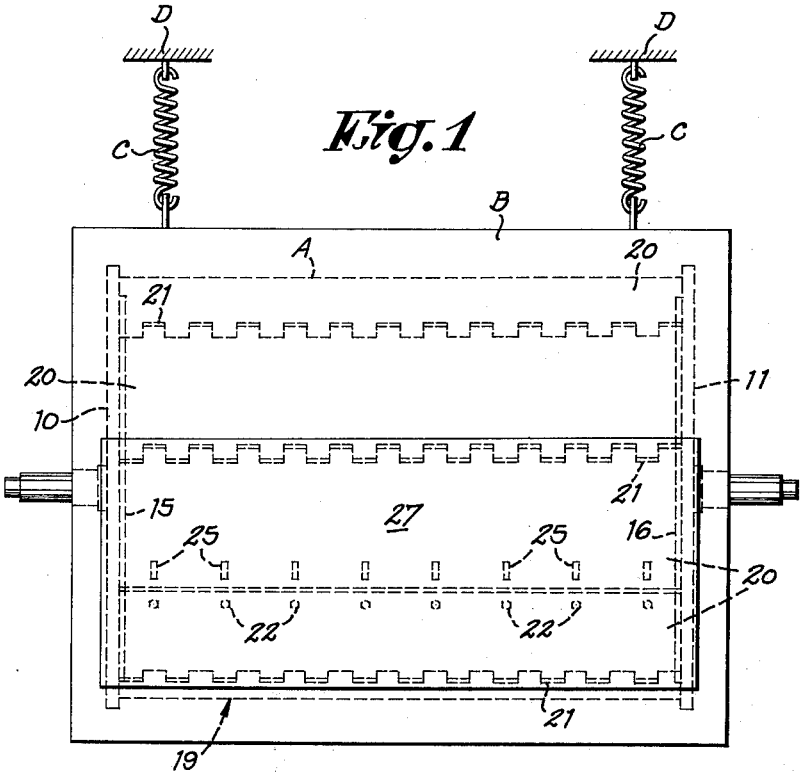
Fig. 1
Fig. 3
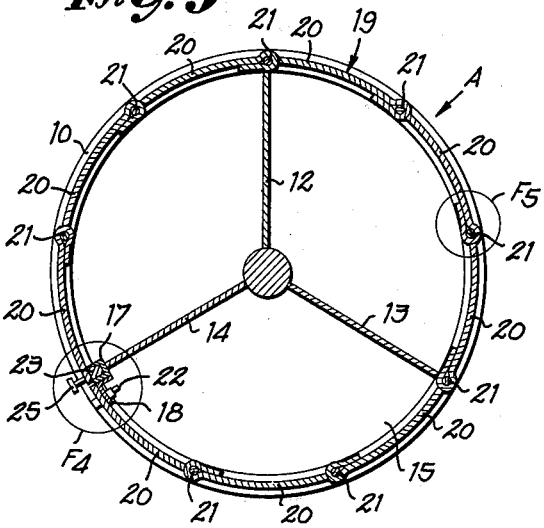
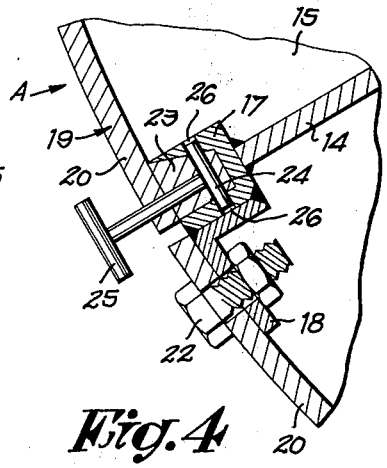
Fig. 4

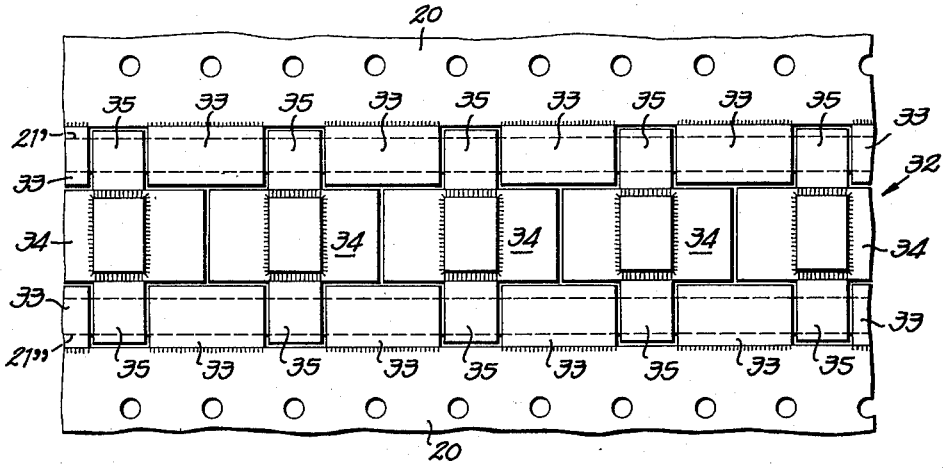
Fig. 8
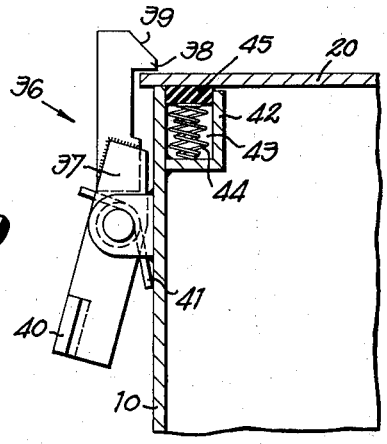
Fig. 9
Fig. 10
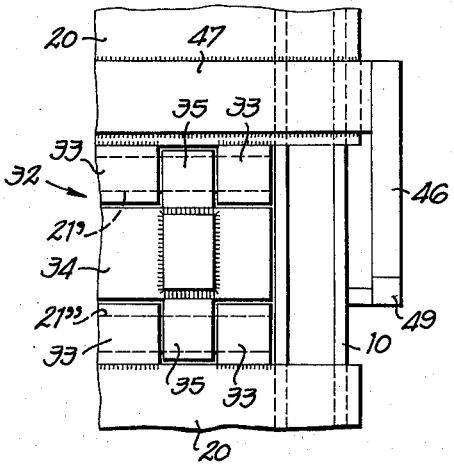
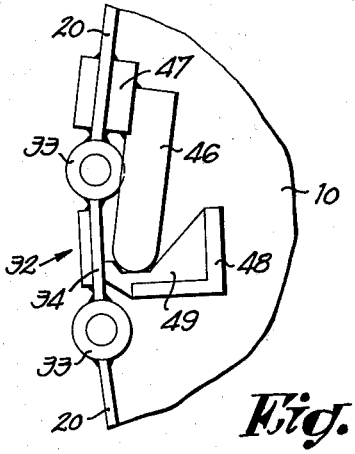
Fig. 11

DRUM FOR WASHER-EXTRACTOR MACHINES

This invention concerns a new drum for washer-extractor machines, in particular for industrial purpose washer-extractor machines having a horizontal drum.

In such machines the drums are generally divided into three compartments in order to limit shiftings of the center of gravity during rotation. An access must then be provided to each compartment; special doors or hatches are therefore provided for this purpose which, in turn requires proper locking and strengthening means. All of this leads to an expensive construction. As the access openings to said compartments must be kept relatively small emptying the drum is both difficult and time-consuming.

The purpose of this invention is to provide for a new type of drum having none of the inconveniences mentioned here-above.

Therefor, a drum is proposed which essentially comprises: two end plates; connecting means between these plates; and a shell consisting of a series of panels hinged one to another along their longitudinal sides, the first panel of the series being anchored to a component of said connecting means and the last panel being fitted with locking means cooperating with said component of said connecting means. For the sake of clarity, some embodiments of the invention are hereinafter described with reference to the appended drawings in which:

FIG. 1 shows a side view of a tub-drum combination according to the invention;

FIG. 3 is a sectional view according to line III—III of FIG. 2;

FIGS. 4 and 5 are enlargements of those parts of FIG. 3, indicated respectively by $F_4$ and $F_5$;

FIG. 8 is a view according to arrow F8 of FIG. 7;

FIG. 9 is a side view of one of the locking means provided for between the panels and the end plates; and FIGS. 10 and 11 respectively show front and side views of tensioning means which intervene when the shell is being closed.

Figure 2:
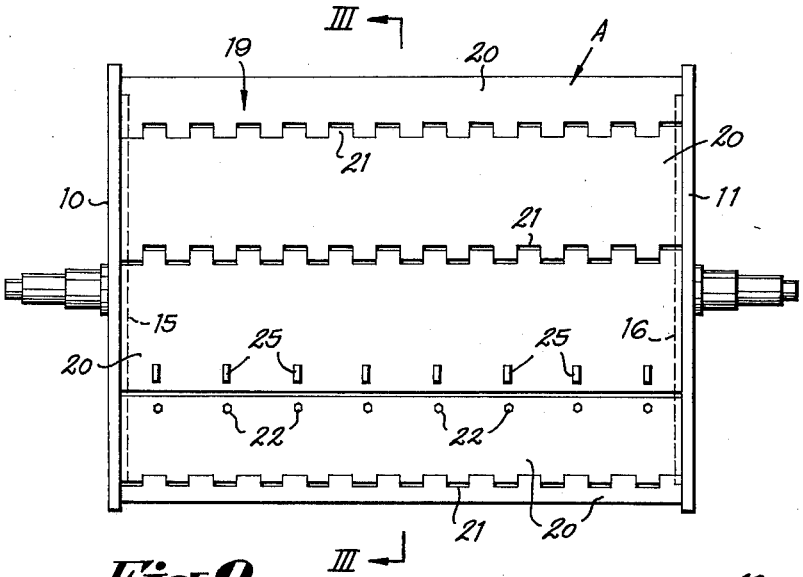
FIG. 2 shows a side view of the drum itself.

As shown in FIG. 1, the drum A is rotatably mounted in the cylindrical tub B. This latter is suspended, for instance, by means of springs C to a frame d. Drum A consists of two end plates 10 and 11, interconnected by three radial partitions 12–14 dividing the drum into three compartments.

These end plates 10 and 11 will each be fitted with an annular projection 15 and 16.

To the free edge of partition 14 — as well as to plates 10–11, is welded a practically U-shaped profile section 17 having a flange 18.

Figure 5:
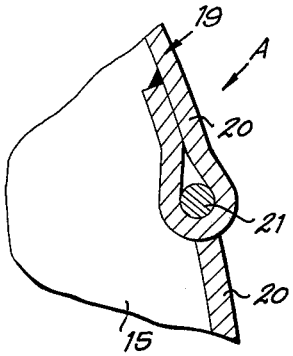

The shell 19 of the drum consists of a series of panels 20 the adjacent longitudinal sides of which being hinged one to another (shaft 21, FIG. 5).

The first panel of the series is anchored by means of bolts 22 to flange 18 of the profile section 17. The last panel is equipped with locking means comprising a cotter-shaped profile section 23 fastened to said last panel. Profile section 23 is provided with a number of recesses each of which receiving a rotary bolt 24. The latter can each be operated by a removable key 25 and can cooperate with openings 26 provided for this purpose in profile section 17. The transverse extremities of panels 20 each rest on said projections 15 and 16 of the end plates when shell 19 is in closed position.

The operation of the hereabove described device is very simple.

Starting with the drum in the position as shown by FIG. 3, loading the drum only requires unrolling the shell 19 through door 27 of tub B and, subsequently, rolling up this shell step by step so that the compartments can be loaded one after the other. For unloading, the shell is merely unrolled continuously or not.

Figure 6:
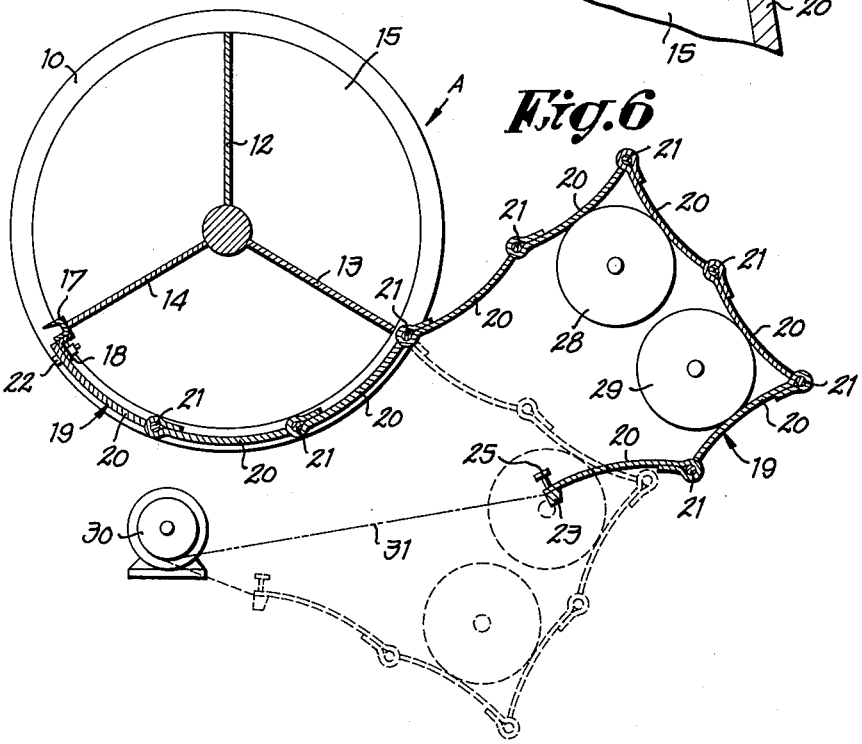
FIG. 6 shows a view similar to that of FIG. 3 but with the shell in half-open position.

Both the rolling up and unrolling operations can be made easier by providing guiding rollers 28–29 next to the tub and chains 31 driven by a motor 30. These chains may be hooked to profile section 23 after said last panel has been opened, for rolling up the shell. Rolling up is achieved by rotating the drum. The drive systems of chains 31 and of drum A are preferably synchronized. Rollers 28–29 are preferably adjustable so that they can be brought from a loading into an unloading position and vice-versa. FIG. 6 shows loading position in full and unloading position in dotted lines.

In the embodiment according to FIGS. 7–11, double hinges 32 are provided between panels 20. These hinges are constituted, on one hand, by a series of small tubes 33 welded to the longitudinal edges of the panels concerned and, on the other hand, by a series of intermediate parts each consisting of a small plate 34 to which are welded two small tubes 35. The length of a small tube 33 is considerably greater than that of a small tube 35. Each hinge 32 has two pivot shafts namely one shaft 21′ extending through the small tubes 33 of one panel as well as through the small tubes 35 at one edge of said intermediate parts, and one shaft 22″ extending through the small tubes 33 of the other panel and through the remaining small tubes 35 (see FIG. 8).

Figure 7:
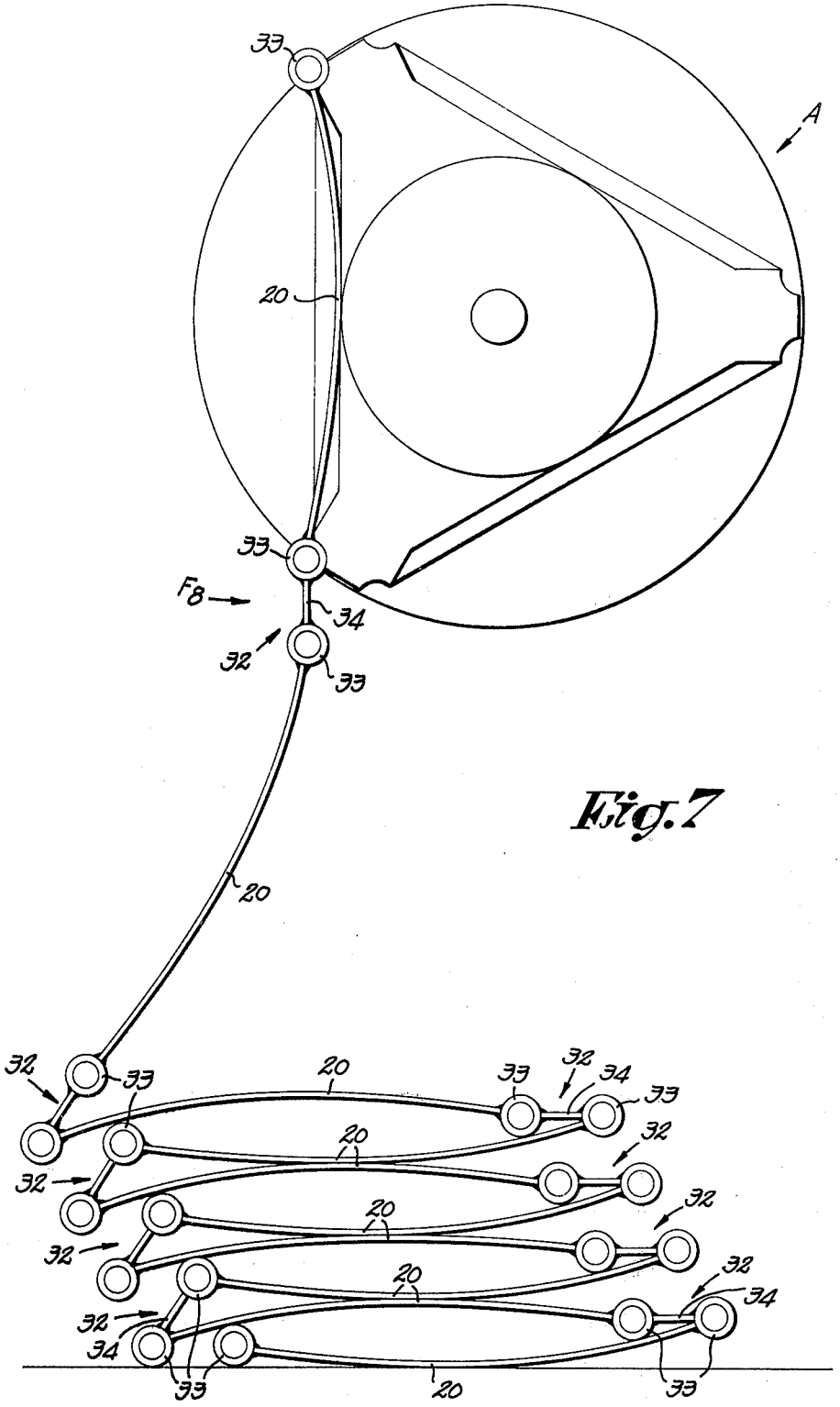
FIG. 7 is a schematic view of a second embodiment of the invention.

The width of the small plates 34 is so chosen — among other things as a function of the width and radius of curvature of panels 20 — that shell 19 of drum A is easily handled when rolling up and unrolling it (FIG. 7).

In order to achieve progressive opening of drum A while shell 19 is being unrolled, the end plates 10 and 11 are equipped with a series of bolts 36.

Preferably, the number of bolts 36 on each end plate will be equivalent to the number of panels or to this number minus one (it is not necessary to lock the last panel of the series).

FIG. 9 shows a bolt 36. Such bolt consists essentially of a profiled lever 37 pivotally supported on the end plate, for instance 10. One extremity of lever 37 has a nose 38 with a bevelled plane 39 while the other extremity has an abutment plane 40. A spring 41 continuously forces nose 38 into its locking position.

To successively release the panels while the shell 19 is being unrolled, it is sufficient to provide, on a fixed part of the machine, opposite to each end plate 10, 11, a stop or cam displaceable, for instance, by means of a pneumatic cylinder and cooperating successively with said abutment planes 40.

The end plates 10-11 are each provided with a ring-shaped profile section 42 forming a peripheral groove housing a series of springs 44 with a rubber ring 45.

In order to tension the shell 19 while closing the last panel 20, this latter is equipped with two levers 46 welded to a bracing bar 47. One connecting means 48 is provided with a bearing part 49 on which the free extremities of levers 46 come to bear while the last panel 20 is being closed. Rotating the latter in the closing direction will tension the entire shell 19.

Numerous modifications may obviously be brought to the embodiments described hereabove by way of example, without exceeding the limits of this invention.

What I claim is:

1. In a washer-extractor machine having a rotary drum, the improvement comprising:

said drum having a pair of end plates;

connecting means between said end plates, said connecting means being a plurality of radial partitions dividing said drum into outwardly open compartments; and an outer shell extending completely around said drum over the outer edges of said partitions and closing all of said compartments, said shell consisting of a single series of panels having adjacent longitudinal edges hinged to each other, the first panel of said series being secured along one longitudinal edge to the outer edge of one of said partitions and the last panel of said series having locking means at its free edge releasably locking the same to the outer edge of said one partition whereby said locking means may be released and said shell unwrapped from said drum to thereby open all said compartments.

2. A drum according to claim 1, wherein said end plates each have, on their mutually facing sides, a ring-shaped projection supporting the axial ends of said panels when the shell is in closed position.

3. A drum according to claim 1, wherein said panels are hinged one to another by means of double hinges, each comprising a series of intermediate parts, each of which comprises a small plate having a small tube welded to each of two opposite sides.

4. A drum according to claim 1, wherein said last panel is equipped, at its free edge, with a cotter-shaped male profile section having recesses, and wherein a female profile section forming part of said connecting means is fastened to the edge of one of said partitions, said female profile section having a flange to which said first panel is anchored and having openings, and wherein said locking means consist of a plurality of bolts pivotally mounted in said recesses of said male profile section to cooperate with said openings when said shell is being closed.

5. A drum according to claim 1, wherein said last panel is equipped with at least one tensioning lever which cooperates with a cam-shaped part on said connecting means when said last panel is closed in such a manner that said last panel is urged into its closed position.

* * * * *